US011796285B1

(12) United States Patent
Major

(10) Patent No.: US 11,796,285 B1
(45) Date of Patent: Oct. 24, 2023

(54) ARCHERY SIGHT

(71) Applicant: Berry Mtn., Inc., Liverpool, PA (US)

(72) Inventor: Jarrod B. Major, Liverpool, PA (US)

(73) Assignee: Berry Mtn., Inc., Liverpool, PA (US)

( * ) Notice: Subject to any disclaimer, the term of this patent is extended or adjusted under 35 U.S.C. 154(b) by 638 days.

(21) Appl. No.: 17/030,639

(22) Filed: Sep. 24, 2020

Related U.S. Application Data

(63) Continuation-in-part of application No. 16/554,740, filed on Aug. 29, 2019, now abandoned.

(60) Provisional application No. 62/724,313, filed on Aug. 29, 2018.

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265; 124/87, 88
See application file for complete search history.

(56) References Cited

U.S. PATENT DOCUMENTS 3,308,540 A * 3/1967 Dean ..... F41G 1/467 33/262
4,813,150 A * 3/1989 Colvin ..... F41G 1/467 42/132
5,094,002 A * 3/1992 Saunders ..... F41G 1/467 42/132
5,228,204 A * 7/1993 Khoshnood ..... F41G 1/467 124/87
5,379,746 A * 1/1995 Sappington ..... F41G 1/467 124/87
5,435,068 A * 7/1995 Thames ..... F41G 1/467 124/87
6,000,141 A * 12/1999 Afshari ..... F41G 1/467 33/265
6,098,608 A * 8/2000 Oshlick ..... F41G 1/467 124/87
7,200,944 B2 * 4/2007 Rager ..... F41G 1/467 124/87
7,392,590 B2 * 7/2008 Gordon ..... F41G 1/467 124/87
8,561,308 B2 10/2013 Adams et al.
(Continued)

*Primary Examiner* — George B Bennett
(74) *Attorney, Agent, or Firm* — Hooker & Habib, P.C.

(57) ABSTRACT

A multi-pin archery sight attached to an archery bow includes a number of sighting pins in a housing and connected to adjustment member movably mounted to the housing for angular displacement between a first operating position and a second operating position. The sighting pins are spaced apart along a longitudinal axis defined by the adjustment member. The longitudinal axis may be vertical with respect to the housing when the adjustment member is in the first operating position and inclined from the vertical when the adjustment member is in the second operating position. A top sighting pin is sighted in by positioning the housing with respect to the bow while the adjustment member is in the first operating position. A lower sighting pin is sighted in by moving and fixing the adjustment member to an operating position away from the first operating position towards the second operating position. After the lower sighting pin is sighted in, all the sighting pins are sighted in for a different target distance associated with each sighting pin.

25 Claims, 8 Drawing Sheets

(56) References Cited

U.S. PATENT DOCUMENTS

| | | | | |
|---|---|---|---|---|
| 8,739,419 | B1 * | 6/2014 | Pulkrabek | F41G 1/467 124/87 |
| 8,869,784 | B2 * | 10/2014 | LoRocco | F41G 1/467 124/87 |
| 9,103,632 | B1 | 8/2015 | Larson | |
| 10,151,563 | B2 | 11/2018 | Schweyen | |
| 10,408,572 | B2 * | 9/2019 | Matthews | F41G 1/467 |
| 2001/0048602 | A1 * | 12/2001 | Khoshnood | G02B 6/4249 362/555 |
| 2021/0325148 | A1 * | 10/2021 | Jones | F41G 1/467 |

* cited by examiner

ARCHERY SIGHT

RELATED APPLICATION

This application is a continuation-in-part and claims the benefit of and priority to pending U.S. patent application Ser. No. 16/554,740 "Archery Sight" filed Aug. 29, 2019 , which in turn claims the benefit of and priority to U.S. patent application Ser. No. 62/724,313 "Archery Sight" filed Aug. 29, 2018, which priority applications are incorporated by reference as if fully set forth herein.

FIELD OF THE DISCLOSURE

This disclosure relates to archery sights.

BACKGROUND OF THE DISCLOSURE

A style of archery sight is a multiple-pin sight. The multiple-pin sight is attached to the bow and utilizes a number of sighting pins, each sighting pin fixed in position within a viewport of the sight and associated with a respective target yardage. The archer estimates the distance to a target and positions the bow to frame the target in the sight and place the appropriate sighting pin over the target. The arrow is then set to fire at the proper launch angle to hit the target at that target distance.

A multi-pin sight typically includes 3 to 5 sighting pins spaced apart vertically in the sight. The upper or top sighting pin is often set for a target at 20 yards. Each lower sighting pin is set for a target at corresponding longer distances and results in corresponding greater launch angles. For example, a 5-pin multi-pin sight may have sighting pins for targets at 20 yards, 30 yards, 40 yards, 50 yards, and 60 yards.

The proper launch angle for a given target distance depends generally on the speed of the bow and the weight of the arrow. A multi-pin sight enables the archer to adjust and then fix the vertical positions of the sighting pins in the sight for the specific bow and arrow used by the archer for each target distance associated with a respective sighting pin.

Generally, the horizontal travel distance of an arrow is reasonably approximated by a range formula which is a function of launch angle, the arrow speed at launch, and the acceleration of gravity (a constant):

$$x=((v*v)\ sin\ 2\Theta)/(g*g)$$

where x is the horizontal distance of travel, v is the arrow speed at launch, Θ is the arrow launch angle, and g is the magnitude of the acceleration of gravity.

Accordingly, assuming a constant arrow speed at launch, the horizontal travel distance is a function of launch angle. The relative vertical offsets of the lower pins of a multi-pin sight from the top sighting pin for specific target distances can therefore be calculated by properly positioning two of the sighting pins and proportionally spacing the other sighting pins from the top sighting pin.

A multi-pin archery sight is disclosed in U.S. Pat. No. 8,561,308 assigned to Bear Archery, Inc., the '308 patent being incorporated by reference as if fully set forth herein. The '308 patent discloses an adjustment mechanism that utilizes the range formula to automatically space the sighting pins by the archer sighting in two target distances. The archer vertically positions the top sighting pin in the sight for a first predetermined target distance, and vertically positions a second sighting pin at a second predetermined target distance. The adjustment mechanism automatically positions the remaining sighting pins for predetermined target distances for each of the remaining sighting pins.

The Bear multi-pin sight simplifies the initial sighting process for the archer. But the adjustment mechanism used in the Bear sight utilizes individually movable sighting pins and so is a complex mechanism.

SUMMARY OF THE DISCLOSURE

Disclosed is a multi-pin archery sight having a simplified sighting pin adjustment mechanism.

The archery sight includes a housing defining a viewport, a number of sighting pins disposed in the housing and visible through the viewport, and an adjustment member extending along a longitudinal axis and being pivotally mounted to the housing for pivotal movement with respect to the housing. The adjustment member is selectively fixable between a first operating position and a second operating position angularly displaced from the first operating position towards or away from the viewport.

The sighting pins include a top sighting pin and at least one lower sighting pin, each sighting pin being connected to the adjustment member for conjoint pivotal movement of the sighting pin with pivotal movement of the adjustment member. The sighting pins are spaced apart from one another in a predetermined relationship along the adjustment member wherein each lower sighting pin revolves about the top sighting pin during pivotal movement of the adjustment member.

Each adjacent pair of sighting pins when the adjustment member is in the first operating position are vertically spaced apart a first predetermined vertical distance from one another, and each adjacent pair of the sighting pins when the adjustment member is in the second operating position are vertically spaced apart a second vertical distance different than the first vertical distance.

The spacing of the sighting pins along the adjustment member may be determined by the range formula, each sighting pin associated with a respective target distance. Changing the angular position of the adjustment member relative to the housing changes the vertical spacing of the sighting pins as viewed by an archer using the archery sight.

In one set of possible embodiments of the disclosed archery sight the connection between the adjustment member and the sighting pins includes each sighting pin being fixedly attached to the adjustment member. In one possible embodiment the adjustment member is an elongate body and the sighting pins are each fixedly attached to the elongate body and do not move with respect to the elongate body. In another possible embodiment the sighting pins are fixedly attached to a respective rung of the adjustment member, each rung forming part of a parallelogram linkage.

In another set of possible embodiments of the disclosed archery sight the lower sighting pins are held by pin holders that extend through a longitudinal through-slot of the adjustment member and into respective channels formed in the housing. The channels space apart adjacent pairs of sighting pins and also guides predetermined movement of the pin holders during pivotal movement of the adjustment member.

The channels predetermine the relative spacing between adjacent pairs of sighting pins as a function of angular displacement of the adjustment member. The channels can be designed to essentially maintain the required spacing dictated by the range equation or, if desired, implement other spacing functions.

The adjustment member enables the archer to sight in the top pin over a first target located a first target distance away, the first target distance being that associated with the top pin, and then displacing the adjustment member to sight in a lower sighting pin over a second target located a second target distance away, the second target distance being that associated with the lower pin. Because pivotal movement of the adjustment member does not affect the vertical position of the top sighting pin in the viewport, the top sighting pin remains properly positioned in the viewport. But in addition, after sighting in the lower sighting pin, the relative vertical positions of the other sighting pins are now properly set in the viewport and do not have to be individually sighted in.

In other embodiments the sighting pins may extend to free ends that are placed over the target. The sighting pins may converge or diverge from one another as they extend to the free ends.

In possible embodiments of the archery sight, the adjustment member may be formed as a rod or plate. The sighting pins may each extend cantilever-style from the adjustment member to a free end of the pin. In other embodiments the adjustment member supports both ends of each of the sighting pins.

The disclosed archery sight enables the user to easily and quickly set the vertical spacing of the sighting pins in the viewport using a relatively simple and reliable sighting pin adjustment mechanism.

Other objects and features of the disclosed archery sight will become apparent as the description proceeds, especially when taken in conjunction with the accompanying drawing sheets illustrating one or more non-limiting embodiments.

DETAILED DESCRIPTION

Figure 1:
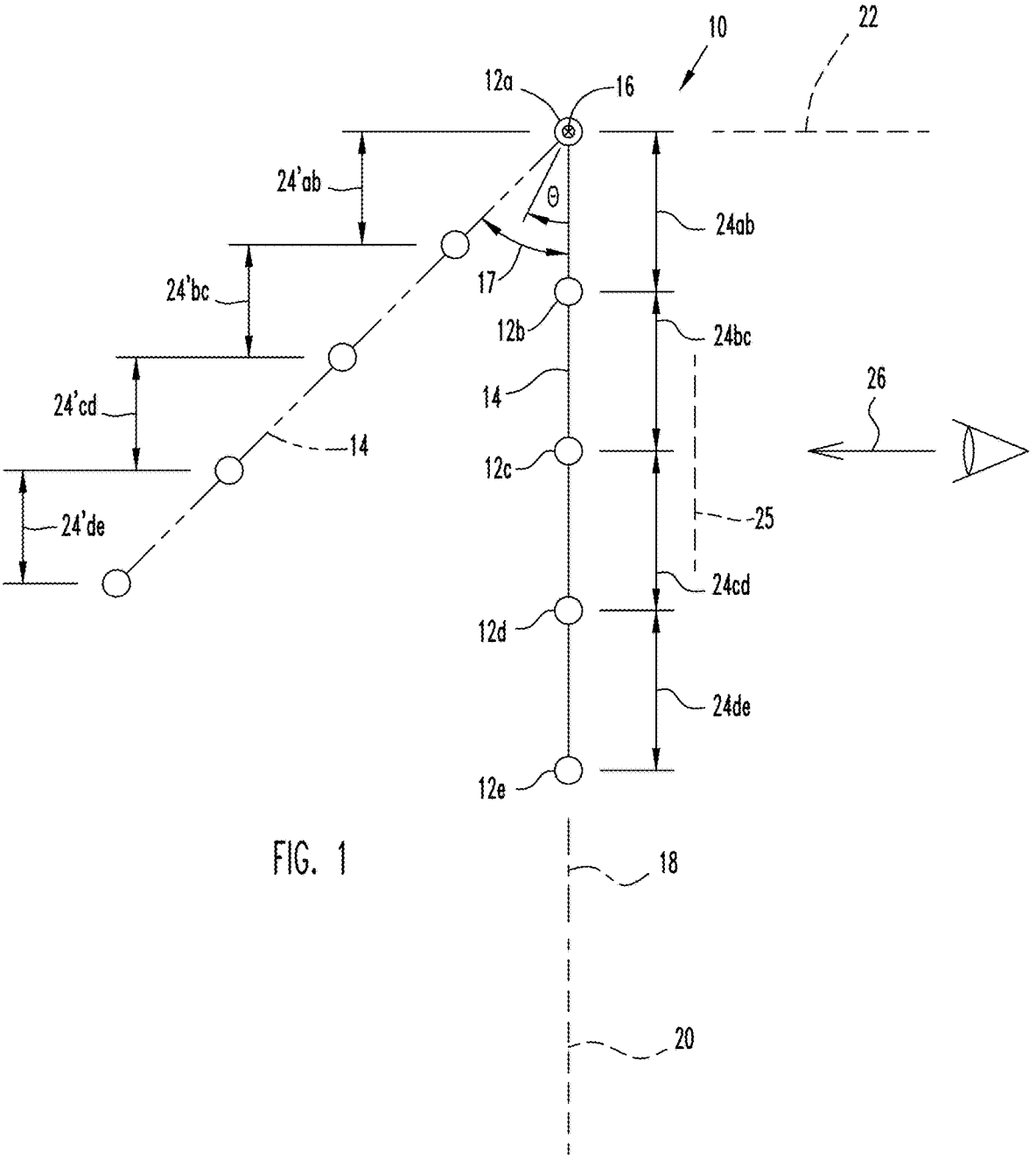
FIG. 1 is a schematic view of operation of an adjustment mechanism for sighting in a multi-pin archery sight in accordance with this disclosure.

FIG. 1 is a schematic view of an embodiment of an adjustment mechanism 10 in accordance with this disclosure for use in a 5-pin archery sight. The adjustment mechanism 10 includes the five sighting pins: a top sighting pin 12*a* and progressively lower sighting pins 12*b*, 12*c*, 12*d*, 12*e*. The sighting pin 12*a* is associated with a 20 yard target distance, the sighting pin 12*b* is associated with a 30 yard target distance, the sighting pin 12*c* is associated with a 40 yard target distance, the sighting pin 12*d* is associated with a 50 yard target distance, and the target pin 12*e* is associated with a 60 yard target distance.

The sighting pins 12 are fixedly attached to an adjustment member formed as an elongate rod 14 extending along an axis. The adjustment member not only assists the archer in selectively setting the relative vertical spacing of adjacent pairs of sighting pins as discussed in more detail below, it also acts as an attachment member that assists in connecting the sighting pins to the sighting mechanism.

The sighting pins are spaced apart axially along the length of the rod. The relative spacing of the pins 12 along the rod is established by the range formula for the target distance associated with each sighting pin, and therefore the ratio a of the spacing of each lower pin 12*b*-12*e* from the top pin 12*a* in relationship to the total distance between the top pin 12*a* and the bottom pin 12*e* is established by the range formula as well.

Each sighting pin 12 extends in a horizontal direction from the rod 14 perpendicular to the drawing sheet as viewed in FIG. 1. The sighting pin 12*a* is located adjacent to a first, upper end of the rod and the sighting pin 12*e* is located adjacent to an opposite second, lower end of the rod.

The rod 14 is pivotable about a horizontal axis 16 that also extends in a first horizontal direction perpendicular to the drawing sheet. The sighting pin 12*a* is centered on and extends along the horizontal axis 16. The rod is pivotable about the horizontal axis from a first operating position shown in solid lines in FIG. 1 to a second operating position shown in phantom lines in FIG. 1. The rod is capable of a maximum angular displacement 17 when moving to/from the first operating position from/to the second operating position, the first and second operating positions marking the opposite ends of a range of angular displacement of the rod about the horizontal axis.

In the first operating position the rod 14 extends along a rod axis 18 that cooperates with the horizontal axis 16 in defining a vertical plane 20 perpendicular to the drawing sheet that includes the rod axis and the horizontal axis 16, and defining a horizontal plane 22 perpendicular to the drawing sheet and to the vertical plane 20. The rod axis 18 defines a vertical axis in the vertical plane 20. The sighting pins 12 are located in the vertical plane. Adjacent pairs of sighting pins are spaced apart by respective linear distances 24*ab*, 24*bc*, 24*cd*, and 24*de*, each linear distance having a vertical component parallel with the vertical axis and having no horizontal component.

When the rod 14 pivots about the horizontal axis 16 an angular displacement 8 towards the second operating position, the rod moves out of the vertical plane 20 and moves towards the horizontal plane 22. The top sighting pin 12*a* rotates about the horizontal axis 16 and does not translate vertically or horizontally with respect to the axis. The other sighting pins 12*b*-12*e* are spaced from the horizontal axis and revolve about the horizontal axis with pivotal movement of the rod about the horizontal axis 16. Adjacent pairs of sighting pins remain spaced apart along the rod by respective linear distances 24*ab*, 24*bc*, 24*cd*, and 24*de*. But each linear distance between adjacent pairs of sight pins 12 now has a vertical component parallel with the vertical axis and a horizontal component perpendicular to the vertical component, the vertical component being less than the corresponding vertical component when the rod is in the first operating position. Trigonometry shows the vertical component of the spacing between an adjacent pair of sighting pins is now distance 24'ij=24ij*cos Θ, wherein the distance 24ij is the distance along the rod 14 between an adjacent pair of sighting pins i and j.

In FIG. 1, the rod 14 drawn in a solid line extends purely vertically from the axis 16 as viewed by the archer, and the rod drawn in a phantom line is inclined from the vertical with respect to the axis 16. But the ratio a as measured only in the vertical direction for each lower pin 12*b*-12*e* for the inclined rod is the same as the ratio a measured in the vertical direction for the purely vertical rod. That is, the ratio a as measured in the vertical direction for each lower pin 12*b*-12*e* remains the same regardless of the angular displacement 8 of the rod.

In use, the archer views the sight pins along a line of sight 26 perpendicular to the vertical plane 20. The apparent vertical separation 24' between adjacent pairs of sighting pins 12 is the vertical component of the separation distance between the pair of sighting pins and are shown in FIG. 1 as distances 24'*ab*, 24'*bc*, 24'*cd*, and 24'*de*.

The archer attaches the archery sight (not shown) having the adjustment device 10 to a bow using a mounting bracket or similar structure (an example of a suitable mounting bracket will be described later below). The mounting bracket enables the archer to adjust the relative position of the archery sight with respect to the bow.

The archery sight includes a housing (not shown in FIG. 1) that contains the adjustment device 10. The archery sight includes a front opening that defines a viewport or sighting plane represented by the dashed line 25 that is parallel with the plane 20. The viewport extends in a vertical direction in the direction of the line 25 and extends in a horizontal direction perpendicular to the drawing sheet. The archer views the sighting pins 12*a*-12*e* through the viewport along a line of sight 26 perpendicular to the viewport.

To sight in the sighting pins 12*a*-12*e*, the archer initially places the rod 14 in the vertical position as shown in solid lines in FIG. 1 (that is, the angular displacement 8 is zero) whereby the vertical spacing between adjacent sighting pins is at a maximum. The archer sights in the top sighting pin 12*a* using a target 20 yards away until the top pin 12*a* is positioned over the target. The archer uses the positioning capability of the sight mounting bracket to position the top pin 12*a* with respect to the bow without moving the rod 14 from its vertical position relative to the sight.

After sighting the top sighting pin 12*a*, the archer then sights in a lower sighting pin (typically, and as an illustrative example, the lower sighting pin 12*b*).

The archer sights in the sighting pin 12*b* using a target 30 yards away. The archer sights in the sighting pin 12*b* by angular displacement of the rod 14 about the horizontal axis away from the vertical until the sighting pin 12*b* is over the target. The adjustment capability of the mounting bracket is not used in this step because it is desired not to maintain the vertical position of the top sighting pin 12*a* with respect to the bow.

Pivotal displacement of the rod 14 about the horizontal axis 16 does not affect the vertical position of the top sighting pin 12*a* in the viewport as viewed by an archer using the archery sight. Thus the top sighting pin 12*a* remains properly positioned in the viewport. But in addition, after sighting in the lower sighting pin 12*b*, the relative vertical positions of the other sighting pins 12*c*, 12*d*, 12*e* are now properly set in the viewport and do not have to be individually sighted in.

In FIG. 1 the sighting pins are horizontal pins in which essentially an entire sighting pin can be placed over a target for aiming the bow, that is, the entire sighting pin is a targeting portion of the sighting pin. In other embodiments of sighting pins a portion of the sighting pin that is less than the entire sighting pin is intended to be placed over the target. In such embodiments the sighting pins 12*a*-12*e* of FIG. 1 can be taken to refer to the targeting portions of the sighting pins.

Figure 3:
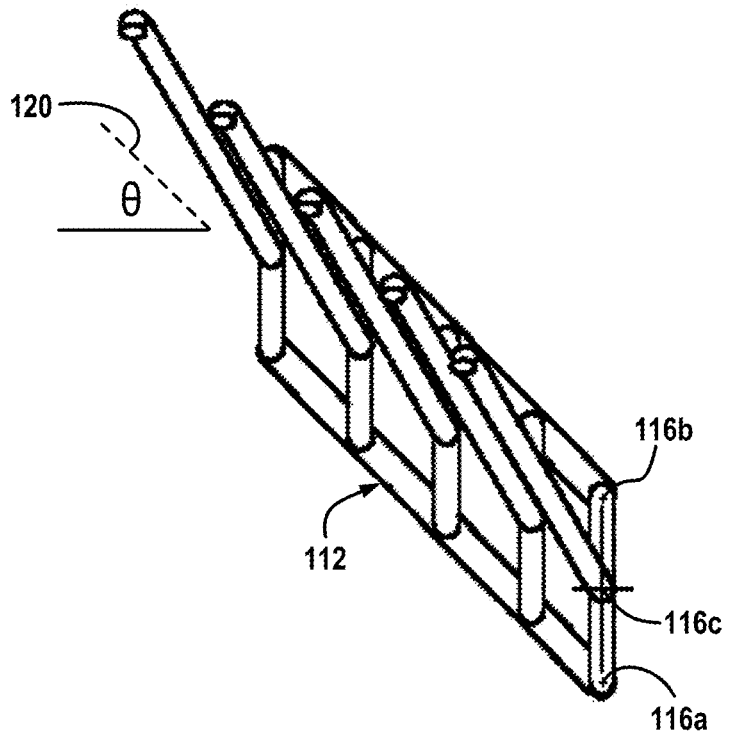
FIG. 3 is similar to FIG. 2 but illustrates the adjustment mechanism after sighting in the second sighting pin of the archery sight.
Figure 2:
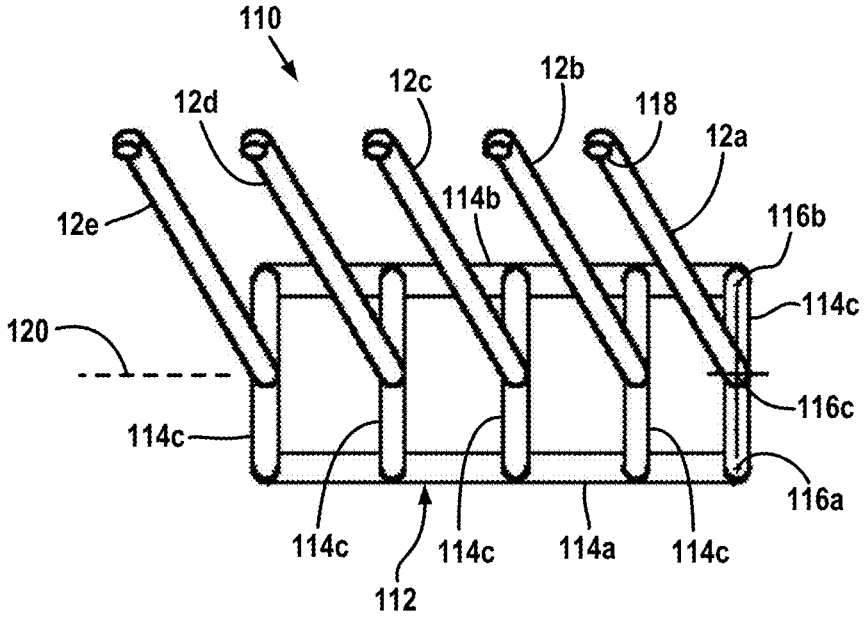
FIG. 2 is a schematic view of a first embodiment adjustment mechanism in accordance with this disclosure prior to sighting in a second sighting pin of the archery sight.

FIGS. 2 and 3 illustrate a second embodiment adjustment mechanism 110 for a multi-pin archery sight in accordance with this disclosure. The adjustment mechanism 110 includes five like sighting pins 12*a*-12*e*. In this embodiment the sighting pins 12*a*-12*e* are each mounted on a parallelogram linkage mounted to one side of the viewport.

The adjustment device 110 includes an adjustment member 112 formed essentially as a set of parallelogram linkages that includes a first side rail 114*a*, a parallel second side rail 114*b*, and like parallel rungs 114*c* spaced along the side rails. The side rails 114*a* and 114*b* are spaced apart in a direction perpendicular to the sighting plane 25 (see FIG. 1). The adjustment member when incorporated into an archery sight housing will be pivotally mounted to the housing whereby the upper ends of the side rails 114*a*, 114*b* are mounted for pivotal displacement about spaced apart respective pivot axes 116*a*, 116*b* that extend horizontally and parallel with the sighting plane to generate pivotal displacement of the sighting pins pivot about an effective pivot axis 116*c*.

Each rung 114*c* extends across the side rails and has opposite end portions pinned to the side rails. The end portions of the top rung 12*a* are pinned for pivotal displacement about the axes 116*a*, 116*b*. Each sighting pin 12*a*-12*e* is centered on and fixedly attached to a respective rung 114*c* between the side rails. Each sighting pin extends away from the rung to a free end that include a respective end surface 118 that faces the sighting plane. In this embodiment the archer places the end surface of the sighting pin over a target, and each end surface corresponds to a respective target distance. The vertical spacing of the end surfaces 118 is in accordance with the range formula as previously described.

FIG. 2 illustrates the adjustment member 112 in its vertical position that corresponds to an singular displacement of the adjustment member 112 from the vertical of zero degrees. Each rung 114*c* extends horizontally away from the side rail 114*a* to the side rail 114*b* in a direction that is perpendicular to the sighting plane 25 of FIG. 1. Each sighting pin 12 extends horizontally from its respective rung 114*c* in a direction parallel with the sighting plane. The pin end surfaces 118 are vertically aligned and spaced apart from one another along a vertical axis 120 that is parallel with the sighting plane. The pin end surfaces 118 face and are parallel to the sighting plane.

The archer sights in the top sighting pin 12*a* by placing the end surface 118 of the top sighting pin 12*a* over the target using the adjustment capability of the archery sight mounting bracket as previously described.

FIG. 3 illustrates the side rails 114*a*, 114*b* of the assembly member 112 each displaced an angular displacement 8 away from the vertical and the sighting plane in response to the archer sighting in a lower sighting pin as previously described. The axis 120 to which the sighting pin end surfaces 118 are spaced along is also displaced an angular displacement 8 about a pivot axis 116*c* centered between and parallel with the side rail pivot axes 116*a*, 116*b*.

Because the rung 114*c* having the top sighting pin 12*a* mounted to it essentially remains stationary with respect to the sighting plane with angular displacement of the adjustment member 112, the top pin 12*a* also remains stationary with angular displacement of the adjusting member. The other sighting pins 12*b*-12*e* revolve about the top pin 122*a* and the pivot 116*c* but also do not themselves pivot with respect to the sighting plane due to the action of the parallelogram linkages (the parallelogram linkage associated with the top sighting pin 12*a* defines essentially a parallelogram having no height). The end surfaces 118 of the sighting pins remain facing and parallel with the sighting plane even with angular displacement of the adjustment member.

The archer sights in a lower sighting pin 12*b*-12*e* by placing the end surface 118 of the lower sighting pin over the target utilizing angular displacement of the adjustment member away from the vertical as previously described. The ratio a as measured in the vertical direction for the sighting pin end surfaces 118 remains effectively the same and approximated by the range formula in FIG. 3 as compared to that in FIG. 2 regardless of the angular displacement of the adjustment member and the action of the parallelogram linkages.

Figure 4:
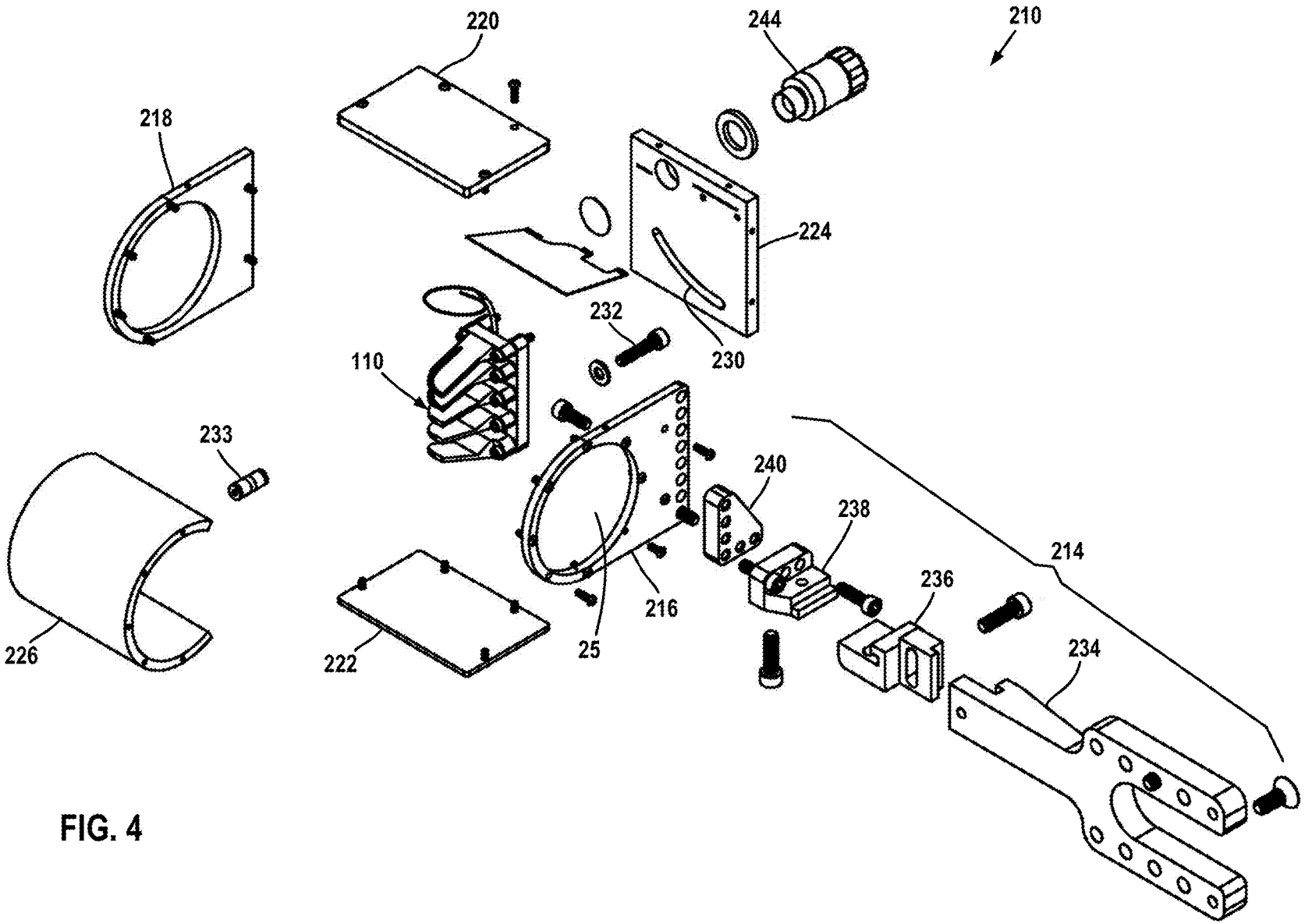
FIGS. 4 and 5 are an exploded view and an assembled view of an archery sight that includes the adjustment mechanism shown in FIGS. 2 and 3.
Figure 5:
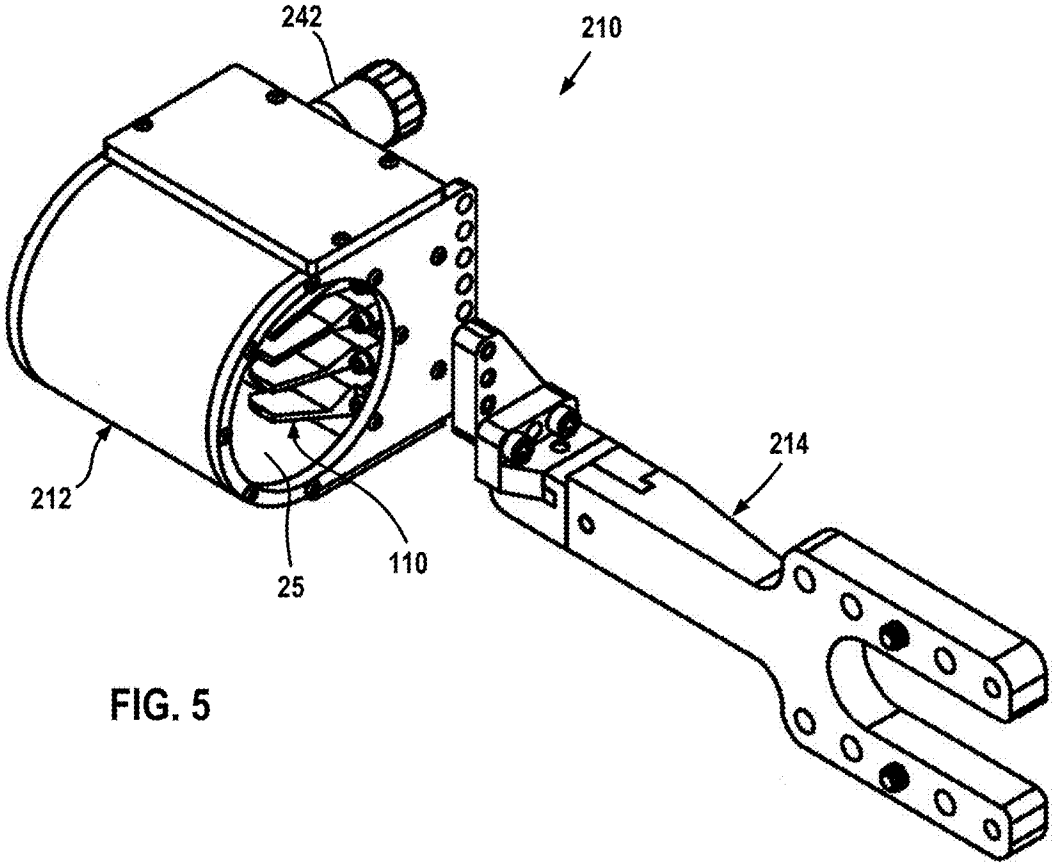

FIGS. 4 and 5 illustrate a 5-pin multi-pin archery sight 210 that includes an embodiment of the adjustment device 110.

The archery sight 210 includes a housing 212 and a mounting bracket 214 that mounts the archery sight to a bow (not shown). The adjustment device 110 is mounted in the housing.

The housing 212 is formed from a front wall 216, an opposite back wall 218, top and bottom walls 220, 222 respectively, a right side wall 224 and a curved left side wall 226.

The front wall 216 has a circular hole that defines the viewport/viewing plane 25 (see FIG. 1) of the archery sight. The adjustment device 110 is mounted in the housing and attached to the flat inner wall surface of the right side wall 224 with the ends of the sighting pins 12*a*-12*e* visible through the viewport. The side rails 114*a*, 114*b* of the adjustment device (see FIGS. 3 and 4) are pivotally mounted to a flat inner surface of the right side wall. The right side wall includes an arcuate slot 230 that receives a screw 232 that extends through the slot and into a threaded blind hole (not shown) formed on the bottom end of the side rail 114*a*. The screw enables the archer to displace the adjustment member 112 and then releasably fix the adjustment member to the housing when sighting in one of the lower sighting pins. A bubble level vial 233 is visible through the viewport to assure the bow is vertical when sighting in the archery sight and when targeting using the archery sight.

The mounting bracket 214 includes a clevis 234 that attaches the archery sight to a bow. Between the clevis and the housing 212 are adjustable positioning members 236, 238, 240 that attach the clevis to the right side of the front wall 216. The front wall and the positioning members have threaded holes and slots that receive screws that releasably fasten the housing to the clevis and allow adjustment of the housing position relative to the bow for sighting in the top sighting pin of the adjustment device 110.

Figure 6:
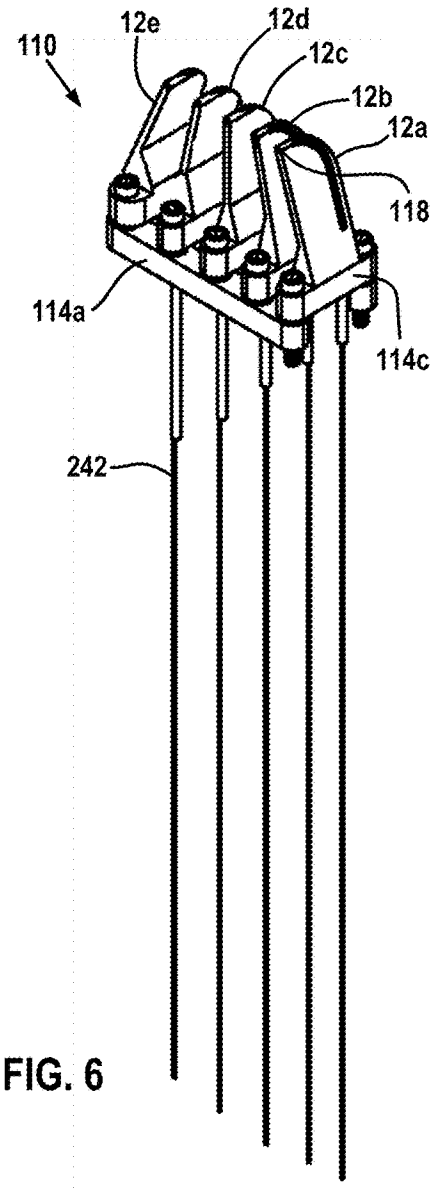
FIG. 6 is a perspective view of the adjustment mechanism shown in FIGS. 4 and 5.

FIG. 6 illustrates the embodiment of the assembly device 110 in the archery sight 210. The sighting pins 12*a*-12*e* are each formed integrally with its associated rung 114*c*. Each sighting pin extends to a free end having an outer surface 118 that faces the sighting plane. The ends 118 of the sighting pins are vertically spaced apart according to the range formula and are targeting portions of the sighting pins placed over the target when shooting. The rungs 114*c* however are spaced a greater distance apart along the adjustment member side rails to provide more room for attachment hardware attaching the rungs 114*c* to the side rails. The uppermost pair of sighting pins 12*a*, 12*b* and the lower most sighting pins 12*d*, 12*e* converge towards the middle sighting pin 12*c* as they extend away from the rungs to position the ends of the sighting pins in their desired vertical positions in the viewport.

Each sighting pin 12 is attached to a respective optical fiber 242 that illuminates the free end of the sighting pin. The intensity of the illumination is controlled by a rheostat 244 (see FIG. 4) accessible to the archer.

Figure 8:
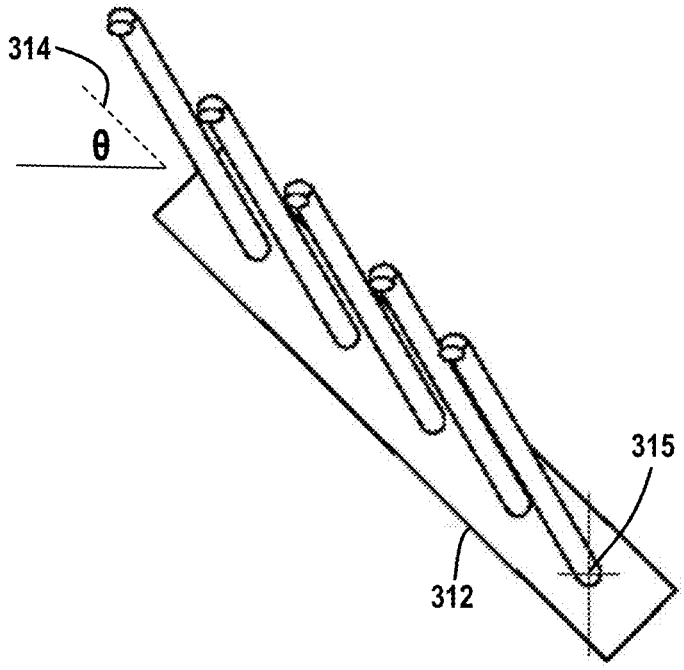
FIG. 8 is similar to FIG. 7 but illustrates the adjustment mechanism after sighting in a second sighting pin of the archery sight.
Figure 7:
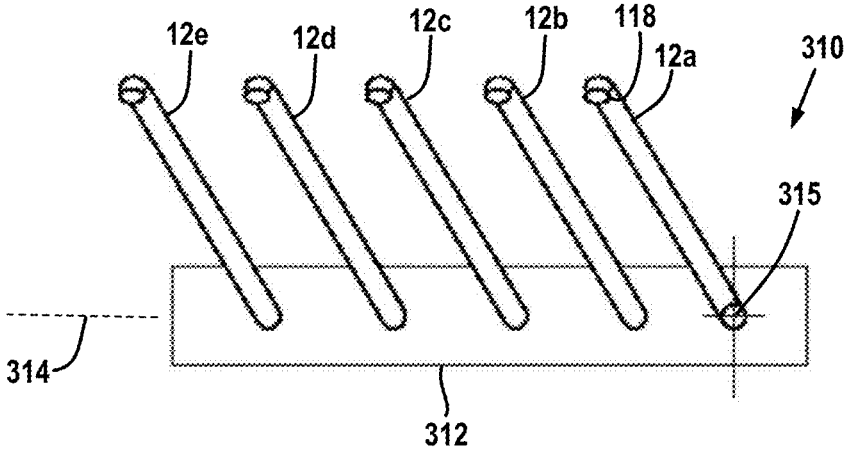
FIG. 7 is a schematic view of a second embodiment adjustment mechanism in accordance with this disclosure prior to sighting in a second sighting pin of the archery sight.
Figure 9:
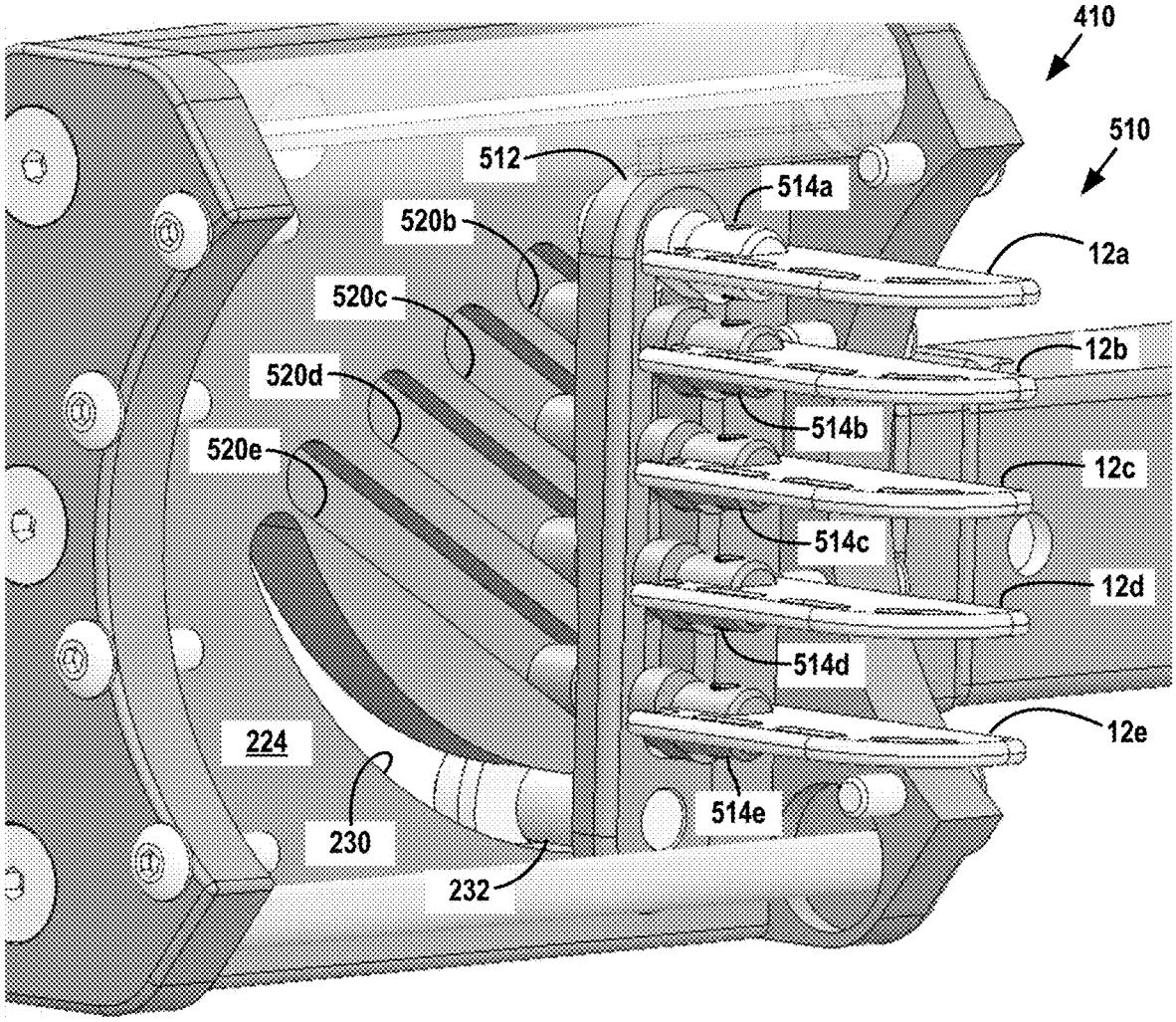
FIG. 9 is a view of a second embodiment archery sight that incorporates a third embodiment adjustment mechanism.

FIGS. 7 and 8 illustrate a second embodiment adjustment device 310 for a 5-pin multi-pin archery sight. The adjustment device can replace the adjustment device 110 in the archery sight 210.

The adjustment device includes an adjustment member 312 that is formed as an elongate plate. The plate is pivotally mounted to the inner wall surface of the right wall 224 (see FIG. 4) for angular displacement about a pivot axis 315 (the sighting pins 12*a*-12*b* extend perpendicularly away from the inner wall surface and plate as viewed in FIGS. 7 and 8 but are shown in a isometric view to clarify the shape of the pins). The screw 232 is fastened to lower end of the plate 312 to adjustably set the angular position of the plate 312 in the housing 212 when sighting in a lower sighting pin.

Spaced along the length of the plate 312 are five parallel sighting pins 12*a*-12*e* rigidly attached to and extending away from the plate. The sighting pin 12*a* is the top sighting pin and sighting pin 12*e* is the lowermost sighting pin. The sighting pins are attached to the adjustment member along an axis 314 extending along the length of the plate and extend away from the plate perpendicular to the plate. Each sighting pin extends to a 90-degree curved free end that has an outer surface 118 that faces the viewport 25 of the archery sight and is parallel with the viewport 25 when the plate is in the vertical position.

Each sighting pin 12 is associated with a respective target distance. The sighting pins and the end surface 318 of the sighting pins are spaced apart from one another in accordance with the range formula.

FIG. 7 illustrates the adjustment member 312 with the axis 315 extending in the vertical direction for sighting in the top sighting pins 12*a*. The top sight pin 12*a* extends along the pivot axis 315. The top pin 12*a* is sighted in by adjusting the position of the archery sight with respect to the bow as previously described.

FIG. 8 illustrates the adjustment member 312 in which the sighting pin axis 314 is set displaced away from the vertical after sighting in a lower sighting pin. Because the adjustment device 310 does not attach the sighting pins 12*a*-12*e* to the adjustment member 312 using parallelogram linkages, the end surfaces 118 of sighting pins 12 will each rotate with respect to the viewport 25 with angular deflection of the adjustment member 312. The end surface 118 of a sighting pin in embodiments can be made as curved or polygonal surfaces to always present a normal or near-normal surface to the archer with angular displacement of the adjustment member.

Alternatively, the sighting pins can be circular pins that are straight for their entire lengths. Thee free end portions of the sighting pins to be placed over a target can be illuminated utilizing fiber optics or made higher contrast with a surface coating or the like. Angular displacement of the adjustment member 312 would then not affect the visual thickness of the sighting pins as seen by the archer.

In other possible embodiments of the adjustment device 310, the adjustment member 312 and the sighting pins 12 may have a different cross section shape. For example, the adjustment member 312 may be formed as a rod or other non-plate-like member. The adjustment member 312 may include a second plate or rail attached to the opposite ends of the sighting pins to provide additional support of the sighting pins. This second plate or rail in embodiments may be attached only to the sighting pins, or be also be pivotally attached to the top housing wall or alternatively the left side housing wall for additional support.

FIGS. 9-15 illustrate components of a second embodiment archery sight 410 that incorporates a 5-pin third embodiment adjustment device 510. The archery sight 410 is similar to the archery sight 210 and so the same reference numbers will be used for corresponding components, and only the differences in the archery sight 410 to incorporate the adjustment device 510 will be discussed.

Figure 10:
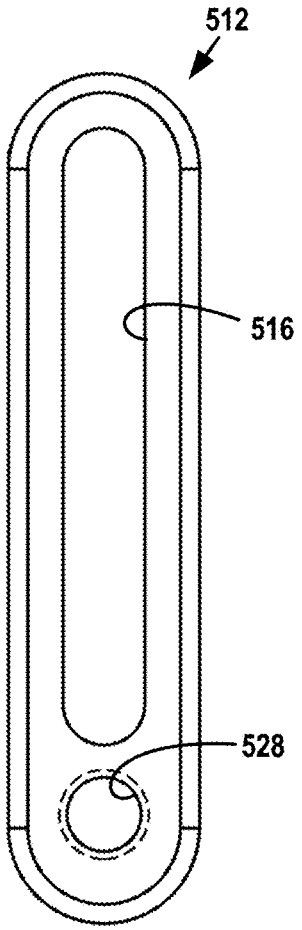
FIG. 10 is a front view of the adjustment member of the adjustment mechanism shown in FIG. 9.
Figure 11:
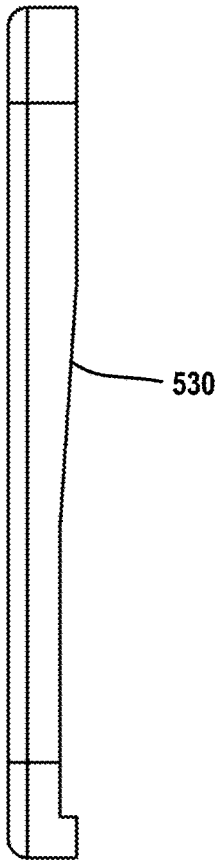
FIG. 11 is a side view of the adjustment member shown in FIG. 10.
Figure 12:
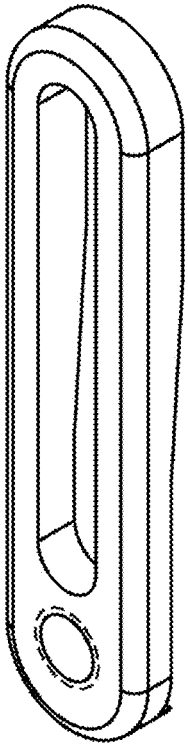
FIG. 12 is a front-side perspective view of the adjustment member shown in FIG. 10.

The adjustment device 510 includes an elongate adjustment member 512 pivotally mounted on a sidewall 224 of the archery sight 410. The adjustment member is shown in FIGS. 10-12. Connected to the adjustment member are five spaced-apart sighting pins 12*a*-12*e*, the sighting pins similar to the sighting pins of the adjustment device 210 but in this embodiment extending parallel with one another and generally perpendicular to the viewing plane of the archery sight.

Each sighting pin 12 is attached to a fastening end of a respective sighting pin holder 514*a*-514*e*. The sighting pin holders each extend from a respective sighting pin through an elongate central through slot 516 of the adjustment member 512.

The sighting pin holder 512*a* carrying the uppermost sighting pin 12*a* is disposed at the upper end 518 of the slot 516 and pivotally mounts the adjustment member 512 to the sidewall 224. The adjustment member is pivotable about the sighting pin 512*a*, which sighting pin defines the pivotal axis of the adjustment member.

The lower sighting pin holders 514*b*-514*e* extend from the respective sighting pins 12*b*-12*e* through the through-slot 516 and are closely received in respective spaced apart linear channels 520*b*-520*e* formed in the sidewall 224.

Figure 13:
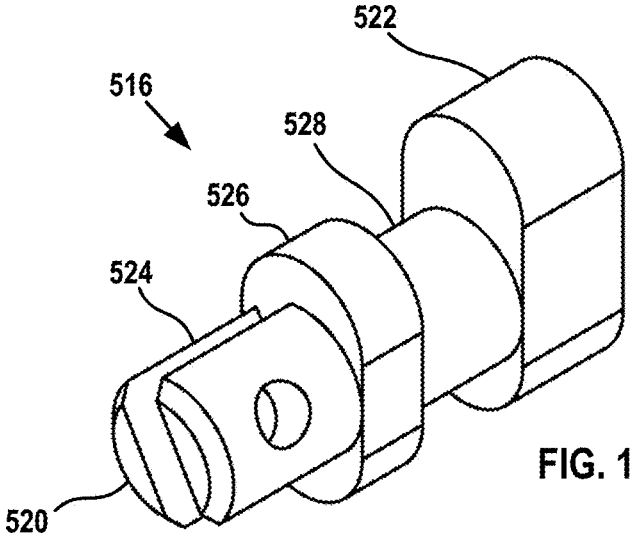
FIG. 13 is a front-side perspective view of a sighting pin holder configured to slide in a channel of the adjustment mechanism shown in FIG. 9.
Figure 14:
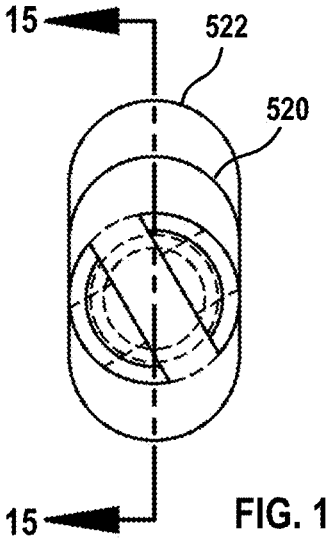
FIG. 14 is a front view of the sighting pin holder shown in FIG. 13.
Figure 15:
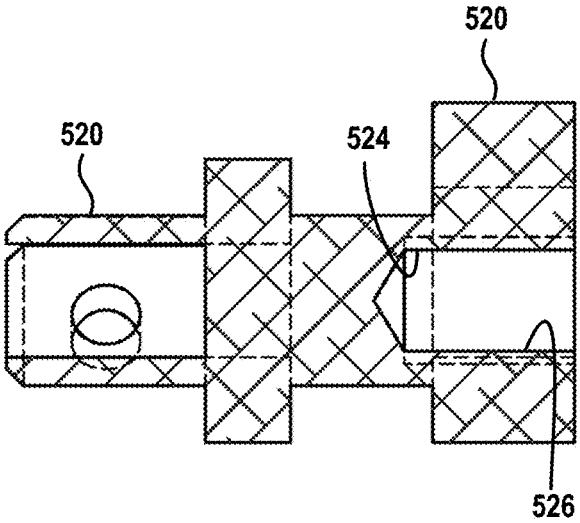
FIG. 15 is a longitudinal sectional view of the sighting pin holder taken along lines 15-15 of FIG. 14.

A lower sighting pin holder 514 is shown in FIGS. 13-15. The lower sighting pin holder is a two-piece body that includes a sighting pin attachment portion 520 and a channel guide portion 522. The sighting pin attachment portion 520 has attachment structure 524 to hold and align the sighting pin, an enlarged base 526 that is positioned against the adjustment member 512, and a circular shank 528 sized to be closely received through the adjustment member slot 516. The channel guide portion 522 is sized to not pass through the slot 516 while being closely received in the channel 520 and being able to move along the channel. Cooperating threaded blind hole 524 and through-hole 526 in the respective portions receive a screw (not shown) that releasably attach the two portions together.

In other possible embodiments a sighting pin holder can be formed as a one piece integral and homogeneous member and the adjustment member can be formed as a two piece member that is fastened together to retain the sighting pin holders in the slot. In yet other possible embodiments the sighting pin and at least the fastening portion of the sighting pin holder can be formed as a one-piece member in which the sighting pin and fastening portion are permanently connected together.

The sidewall 224 includes an arcuate slot 230 that receives a screw 232. The screw extends from outside the archery sight 410 and screws into a threaded hole 528 formed in the lower end of the adjustment member 512. The screw functions as a handle permitting the archer to selectively pivot and hold the adjustment member as needed along the sidewall 224 for sighting the sighting pins. The side 530 of the adjustment member facing the sidewall is shaped to have a relatively low contact area against the sidewall.

The resulting angular displacement of the adjustment member 512 causes conjoint angular displacement of the sighting pins 12*b*-12*e* that cause the pin holders 514*b*-514*e* to move along and be guided by the respective channels 516*b*-516*e*.

In the illustrated embodiment the channels 516*b*-516*e* are configured to substantially maintain the relative spacing of the sighting pins 12*a*-12*e* along the axial member 512 sufficient to maintain the appropriate target distance associated with each sighting pin when sighting the archery sight.

Sidewalls 224 can be provided for different numbers of sighting pins, having different configurations of the channels for a different set of target distances, or for other relationships between the sighting pins. Channels can be linear channels, curved or arcuate channels, or a mix of linear and curved or arcuate channels. A channel can be linear along its entire length or can have mixed linear and curved or arcuate portions.

While one or more embodiments are disclosed and described, it is understood that this is capable of modification and that the scope of the disclosure is not limited to the precise details set forth but includes modifications obvious to a person of ordinary skill in possession of this disclosure, including (but not limited to) the number of sighting pins, the spacing of the sighting pins corresponding to other, different target distances (including non-uniform differences in targeting distances associated with respective adjacent sighting pins), changes in material selection, size, operating ranges (including the maximum angular displacement of the adjustment member), housing construction and configuration, mounting bracket construction and configuration, direction of angular displacement of the adjusting member, shape and length of the sighting pins, illumination of the sighting pins, environment of use, shape, and also such changes and alterations as fall within the purview of the disclosure and the following claims.

What is claimed is:

1. A multi-pin archery sight comprising:

a housing, a plurality of sighting pins disposed in the housing, and an adjustment member defining and extending along a longitudinal axis;

at least a portion of each sighting pin being a targeting portion that is to be placed over a target when using the sighting pin for aiming at the target;

the housing defining a viewport extending in a vertical direction and a horizontal direction with respect to the housing, the targeting portions of the plurality of sighting pins being visible when an archer looks through the viewport;

the adjustment member being pivotally mounted to the housing for pivotal movement about a pivot axis with respect to the housing, the adjustment member being selectively fixable between a first operating position and a second operating position angularly displaced about the pivot axis from the first operating position towards or away from the viewport;

the plurality of sighting pins comprising a top sighting pin and at least one lower sighting pin, each of the at least one lower sighting pins being connected to the adjustment member and conjointly movable with the adjustment member;

the plurality of sighting pins being axially spaced apart from one another along the longitudinal axis of the adjustment member in a predetermined axial spacing when the adjustment member is in the first operating position wherein each at least one lower sighting revolves about the top sighting pin during pivotal movement of the adjustment member;

each adjacent pair of the plurality of sighting pins when the adjustment member is in the first operating position being vertically spaced apart a first vertical distance from one another; and the plurality of sighting pins being axially spaced apart from one another along the longitudinal axis in a predetermined axial spacing when the adjustment member is in the second operating position, each adjacent pair of the plurality of sighting pins when the adjustment member is in the second operating position being vertically spaced apart a second vertical distance different than the first vertical distance.

2. The archery sight of claim 1 wherein the top sighting pin is disposed on the pivot axis.

3. The archery sight of claim 1 wherein the adjustment member comprises a pair of elongate rails and rungs connecting the rails, each sighting pin of the plurality of sighting pins being fixedly attached to a respective rung.

4. The archery sight of claim 1 wherein the rungs are pinned to the rails wherein each rung can pivot with respect to the side rails to cause pivotal movement of the adjustment member.

5. The archery sight of claim 3 wherein the pair of rails are spaced apart in a direction perpendicular to the viewport.

6. The archery sight of claim 1 wherein the second axis is a horizontal axis extending in the horizontal direction of the the viewport.

7. The archery sight of claim 1 wherein the housing includes an arcuate opening, a body attached to the adjustment member and extending from the adjustment member, through the opening, and out of the housing.

8. The archery sight of claim 7 wherein the body releasably selectively fastens the adjustment member in a selected fixed angular position about the pivot axis.

9. The archery sight of claim 1 wherein the adjustment member is a rigid body.

10. The archery sight of claim 1 wherein each sighting pin comprises a first portion extending from the adjustment member parallel with the viewport and the targeting portion of the sighting pin is a second portion extending away from the first portion towards the viewport.

11. The archery sight of claim 1 wherein the spacing of the plurality of sighting pins along the adjustment member in the first operating position is determined by the range formula, each sighting pin of the plurality of sighting pins being associated with a respective target distance.

12. The archery sight of claim 11 wherein the difference in target distance associated with respective adjacent pairs of the plurality of sighting pins is a constant difference N for each respective adjacent pair of sighting pins.

13. The archery sight of claim 1 including an attachment bracket attached to the housing, the attachment bracket being configured to attach the archery sight to a bow when the archery sight is being used by an archer.

14. The archery sight of claim 1 wherein the archery sight includes a mounting bracket being configured to mount the housing to a bow, the mounting bracket having a positioning capacity to selectively position the housing with respect to the bow wherein an archer can sight in the top sighting pin when the adjustment member is in the first operating position by using the positioning capacity of the mounting bracket and without displacing the adjustment member with respect to the housing.

15. The archery sight of claim 14 wherein the housing is attached to a bow and the top sighting pin is positioned with respect to the bow for a first target distance, and the at least one lower sighting pin includes a lower sighting pin spaced from the top sighting pin, and the adjustment member is displaced to an operating position away from the first operating position towards the second operating position wherein the lower sighting pin is positioned with respect to the bow for a second different target distance without displacing the housing with respect to the bow.

16. The archery site of claim 1 wherein the adjustment member includes a longitudinal through-slot, the at least one lower sighting pins attached to respective sighting pin holders that extend through the slot.

17. The archery sight of claim 16 wherein the adjustment member is pivotally mounted to a wall of the housing, the sighting pin holders extending through the slot to respective ends carried in respective channels formed in the wall.

18. The archery sight of claim 17 wherein one or more of the respective channels is a linear channel.

19. The archery sight of claim 16 wherein the top sighting pin is fastened to a sighting pin holder extending through the slot and being disposed on the pivotal axis of the adjustment member.

20. A method for sighting in a multi-pin archery sight of claim 1 attached to a bow, the method comprising the steps of:

(a) sighting in the top sighting pin by adjusting the position of the housing with respect to the bow while maintaining the attachment member in the first operating position; and (b) after performing step (a), sighting in a lower sighting pin of the one or more lower sighting pins by displacing and fixing the adjustment member to an operating position away from the first operating position towards the second operating position without changing the position of the housing with respect to the bow whereby all the sighting pins of the plurality of sighting pins are sighted in after performing this step (b).

21. A method for sighting in the sighting pins of a multi-pin archery sight attached to a bow, the sighting pins disposed in a housing of the archery sight and comprising a top sighting pin and at least one lower sighting pin, each of the sighting pins being spaced apart from one another in a predetermined relationship along an axis, each sighting pin associated with a different respective target distance, the method comprising the steps of:

(a) sighting in the top sighting pin of the plurality of sighting pins by positioning the housing with respect to the bow while maintaining the sighting pins stationary with respect to the housing;

(b) after sighting in the top sighting pin, sighting in one of the one or more lower sighting pins by simultaneously revolving all the lower sighting pins around the top sighting pin until the one lower sighting pin is sighted in, and (c) then fixing the positions of the one or more lower sighting pins with respect to the top sighting pin with the one lower sighting pin in the sighted-in position.

22. The method of claim 21 wherein the sighting pins are rigidly attached to an adjustment member and step (b) comprises the step of:

(d) angularly deflecting the adjustment member with respect to the housing.

23. The method of claim 21 wherein step (b) comprises revolving the one or more lower sighting pins about the top pin without rotating the one or more lower sighting pins.

24. The method of claim 21 wherein the housing defines a viewport and step (b) comprises revolving the one or more lower sighting pins towards or away from the viewport.

25. The method of claim 21 wherein step (b) wherein the respective paths of revolution of the one or more lower sighting pins is defined by respective channels formed in the housing.

* * * * *